United States Patent [19]

Livemore

[11] 4,334,892

[45] Jun. 15, 1982

[54] GAS PRODUCER APPARATUS INCLUDING A WATER JACKET

[75] Inventor: Gerald S. V. Livemore, Parkmore, South Africa

[73] Assignee: Foster Wheeler Energy Corporation, Livingston, N.J.

[21] Appl. No.: 174,283

[22] Filed: Jul. 31, 1980

[51] Int. Cl.[3] ..... C10J 3/76

[52] U.S. Cl. ..... 48/76; 48/67; 48/87; 122/5

[58] Field of Search ..... 48/76, 87, 67, 68; 122/5, 15; 110/229

[56] References Cited

U.S. PATENT DOCUMENTS

| | | | |
|---|---|---|---|
| 2,832,678 | 4/1978 | Ackeren | 48/87 |
| 4,134,738 | 1/1979 | Bress et al. | 48/87 |

*Primary Examiner*—Peter F. Kratz

*Attorney, Agent, or Firm*—Marvin A. Naigur; John E. Wilson

[57] ABSTRACT

A water jacket for coal gasification in which the gas producer is provided with an inwardly directed collar spaced from the water jacket and a plurality of apertures through the collar formation such that the collar can assist in supporting the refractory material of the wall of the gas producer.

6 Claims, 2 Drawing Figures

GAS PRODUCER APPARATUS INCLUDING A WATER JACKET

This invention relates to water jackets of the kind used in two stage gas producers.

Two stage gas producers are known in the trade and generally these comprise an elongated cylindrical structure comprising an upper section of refractory material, a water jacket disposed immediately below the upper section and a seal skirt extending from the lower end of the water jacket. In this specification the upper section of refractory material will be referred to as the wall of the producer.

Inside the water jacket a conical grate, which may be rotatable, is disposed and in use an air and steam mixture is fed into the producer via the grate. Coal is fed into the producer from one or more bunkers disposed at the upper extremity of the wall of the producer. The rate at which the air and steam mixture is fed into the producer is adjusted such that a firebed, which is formed in the coal, is disposed approximately halfway between the ends of the water jacket.

Two gas fractions are separated in two stage producers namely the bottom gas, i.e. the gas which is collected relatively close to the firebed and the top gas, i.e. the fraction which is collected at or towards the upper extremity of the producer.

It is known to collect the bottom gas through the agency of a plurality of evenly spaced flues which are disposed inside the wall of the producer.

In known gas producers the lower extremity of the wall of the producer defines a recessed zone which zone houses the inlets to the flues. Poke holes are also normally located in this region of the producer and it is accordingly often found that the lower extremity of the wall of refractory material is the weakest part of the producer.

As the recessed zone from which the gas collecting flues extend is normally substantially filled with coal, the gas in the flues often entrain undesirable dust particles which have to be removed before the gas can be utilized.

It is an object of the present invention at least to minimise some of the disadvantages of known gas producers.

According to the invention a water jacket adapted to be included in a gas producer is characterised by an inwardly directed collar formation spaced from the upper extremity of the water jacket and a plurality of apertures through the collar formation, the arrangement being such that in use the collar assists in supporting the refractory material of the wall of the producer and each aperture constitutes an inlet to a flue extending inside the wall.

Preferably the upper and lower surfaces of the collar extend substantially normally to the inner surface of the water jacket.

Further according to the invention a water jacket of the kind in question is characterised in that it includes at least one poke hole through which in use a poke rod may be introduced for poking a firebed disposed inside the water jacket. Preferably a plurality of evenly spaced poke holes are provided around the periphery of the water jacket.

According to a further aspect of the present invention an annular storage tank for water is provided at the upper extremity of a gas producer in heat contact with the producer wall.

The water jacket may be gravity fed with water from the storage tank at the upper extremity of the producer via a suitable control arrangement. Preferably the control arrangement is of a kind by which water lost as steam is replenished continuously so that the water temperature remains constant.

Without restricting the scope of the invention a preferred embodiment will now be described with reference to the accompanying drawings in which.

Figure 1:
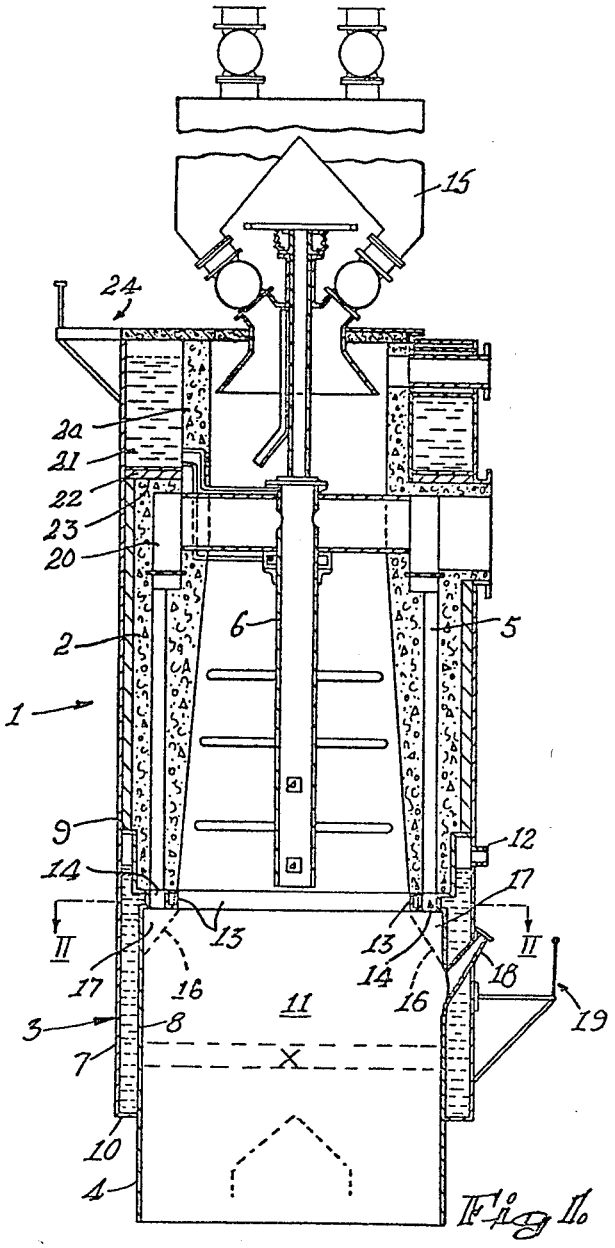
FIG. 1 is a diagrammatic sectional elevation of a gas producer according to the invention.
Figure 2:
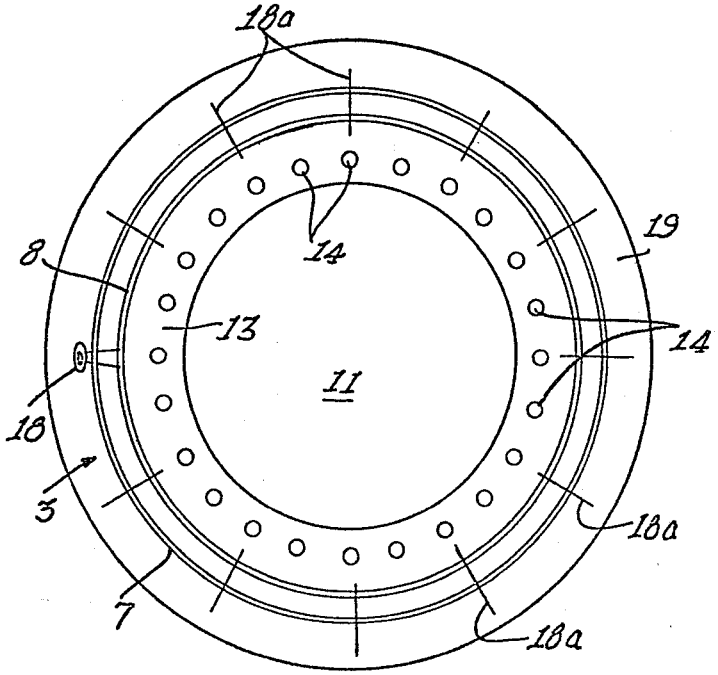
FIG. 2 is a section on line II—II through FIG. 1.

Referring to the accompanying drawings a gas producer 1 comprises a wall 2 of refractory material which may comprise bricking or castable refractory material.

Disposed below the wall 2 is a water jacket 3 and a seal skirt 4 extends from the lower end of the water jacket 3.

The bottom gas collecting system comprising flues 5 and the central revolving flue 6 shown in the drawing is described in more detail in our co-pending application entitled "Improvements in or relating to Gas Producers—A", U.S. patent application Ser. No. 174,286 filed July 31, 1980.

The water jacket 3 comprises an inner cylindrical wall 8 and an outer cylindrical wall 7 which are co-axially disposed and interconnected by a top 9 and a bottom 10 to constitute an annular vessel defining a central chimney zone 11.

The water jacket 3 is provided with an inlet for water (not shown) and an outlet for steam 12.

An inwardly directed collar formation 13 extends from the inner wall 8 of the water jacket 3 substantially normally to the surface of wall 8.

A plurality of apertures 14 are provided through the collar and in use these apertures 14 constitute the inlets of flues 5.

When the coal is fed into the producer from the bunkers 15 the coal inside the inner wall 8 will form a sloping annular surface below the collar 13 as is indicated by the broken lines 16. The angle of inclination of the surface so formed will be dependant on the angle of repose of the coal. Thus an annular void 17 is formed immediately below the inlet to the flue and this has the result that less dust will be entrained in the gas stream which flows through the flue than what is experienced with known gas producers.

The water jacket itself is also provided with a number of poke holes 18, the centre lines of which are indicated at 18(*a*), and a catwalk 19 is provided around the circumference of the water jacket 3. It will be seen that with this arrangement the poke holes are substantially closer to the firebed zone X than what is the case with poke holes through the wall of the producer as is normally used thus making poking of the fire substantially easier compared to known producers.

The invention also includes means for delivering steam from the outlet 12 of the water jacket to the poke holes for creating a steam curtain to prevent the gas produced in the producer from escaping through the poke hole whilst poking is carried out.

Conventional producers often include a shoulder formation above the bottom gas collecting conduit 20. According to the present invention this space is utilised by providing an annular storage tank 21 for water which encircles the upper zone of the producer 1. A layer of suitable ceramic fibre insulating material 22 is provided between the bottom of the annular tank 21 and the shoulder formation 23 defined by the wall 2.

Due to heat losses through the wall 2 and particularly through the section 2(*a*) thereof the water in the tank 21 is being pre-heated to a certain extent.

Water lost in the form of steam from the water jacket 3 is replenished from the tank 21 by means of pipes and valves which are not shown in the drawings. It is preferred to employ a value which is designed to replenish the water in the water jacket at substantially the same rate as the rate of vaporization of the water therein, thus ensuring that the water temperature in the jacket remains substantially constant.

The water in the tank 21 is also utilized to cool the bearing surfaces as is more fully described in our copending application entitled "Improvements in or relating to Gas Producer—A".

A cat-walk and working platform 24 is provided at the top of the tank 21 which allows easy access to the bunkers 15.

It will be appreciated that many variations in detail may be thought of without thereby departing from the spirit of the invention.

What is claimed is:

1. A gas producer comprising a vertically extending water jacket enveloping the lower portion of the gas producer characterized by an inwardly projecting collar containing coolant spaced from and interior of the vertical inner wall of the upper extremity of the water jacket, and a plurality of apertures extending through the collar, and a steam outlet positioned between the upper extremity of the water jacket and the collar, wherein the collar assists in supporting the refractory material of the wall of the gas producer and each aperture is located above a surface of the fire bed of the producer and constitutes an inlet to a flue extending inside said refractory wall for directing product gas upwardly through the refractory so that water can be maintained within the water jacket at a level between the collar and the steam outlet to protect by the refractory the portion of the water jacket not cooled by water.

2. The gas producer of claim 1 wherein the upper and lower surfaces of the collar extend substantially normally to the inner surface of the water jacket.

3. The gas producer of claim 1 characterised in that it includes at least one poke hole through which in use a poke rod may be introduced for poking a firebed disposed inside the water jacket.

4. The gas producer of claim 3 wherein a plurality of evenly spaced poke holes are provided around the periphery of the water jacket.

5. The gas producer of claim 4 further comprising a bunker for feeding coal into the producer.

6. A gas producer according to claim 1 further including an annular storage tank for water at its upper extremity and in heat contact with the producer wall, the tank being adapted to feed water to the water jacket disposed at the lower extremity of the producer wall.

* * * * *